United States Patent [19]

Kochte

[11] 4,335,486

[45] Jun. 22, 1982

[54] SURFACE CLEANING MACHINE

[75] Inventor: Werner W. Kochte, Ravenna, Ohio

[73] Assignee: The Scott & Fetzer Company, Twinsburg, Ohio

[21] Appl. No.: 117,263

[22] Filed: Jan. 31, 1980

[51] Int. Cl.[3] ..... A47L 7/00

[52] U.S. Cl. ..... 15/321; 15/322

[58] Field of Search ..... 15/320, 321, 322

[56] References Cited

U.S. PATENT DOCUMENTS

| | | | |
|---|---|---|---|
| 4,069,541 | 1/1978 | Williams | 15/321 |
| 4,185,354 | 1/1980 | Brazier | 15/321 |
| 4,282,626 | 8/1981 | Schneider | 15/322 X |
| 4,307,484 | 12/1981 | Williams | 15/321 |

FOREIGN PATENT DOCUMENTS

| | | | |
|---|---|---|---|
| 2361894 | 6/1975 | Fed. Rep. of Germany | 15/320 |
| 1496564 | 12/1977 | United Kingdom | 15/321 |

*Primary Examiner*—Chris K. Moore

*Attorney, Agent, or Firm*—Pearne, Gordon, Sessions, McCoy & Granger

[57] ABSTRACT

A carpet or rug cleaner forms a bead of water or other cleaning fluid across the width of a cleaning head. The bead of fluid is applied on the pile of a carpet or rug, and the fluid is violently pulled, by the force of the applied vacuum, from the bead or from the region of the bead through the pile of the carpet or rug to a vacuum uptake with only limited downward penetration of the fluid into the pile. Cleaning action is vigorous, fluid recovery is enhanced, and drying time reduced.

11 Claims, 8 Drawing Figures

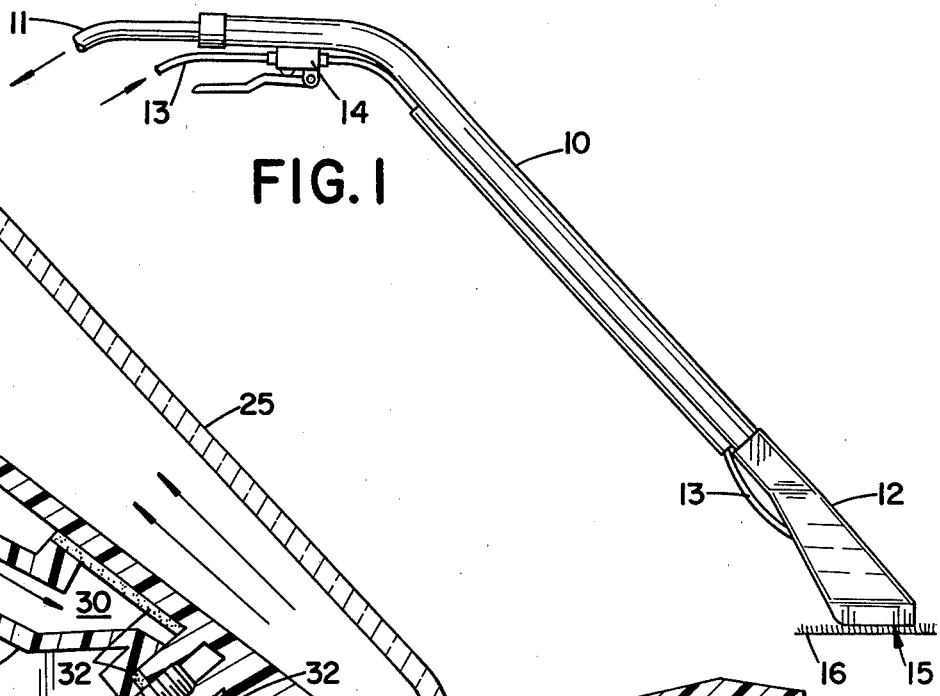
FIG. 1
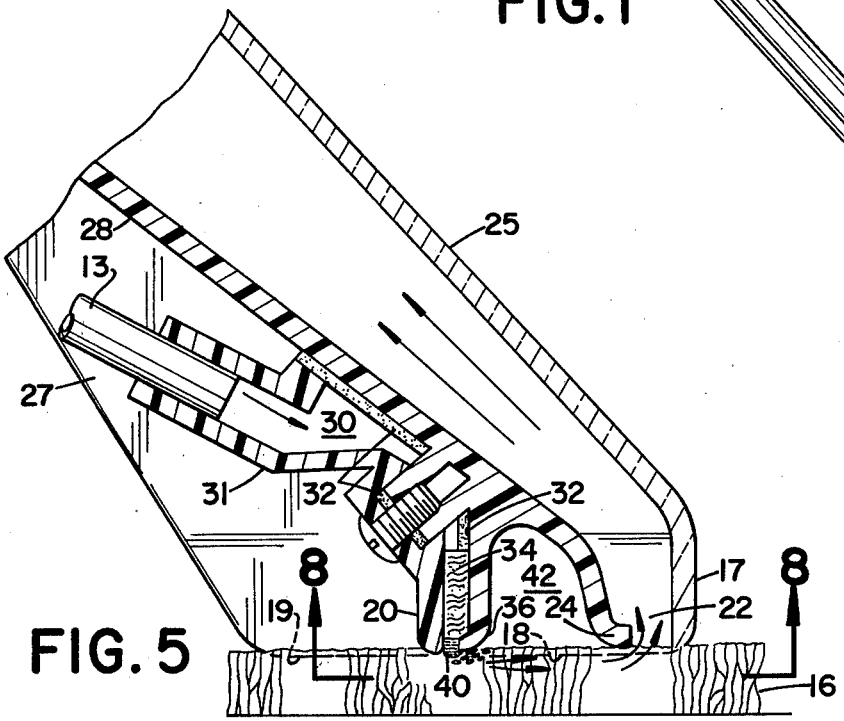
FIG. 5
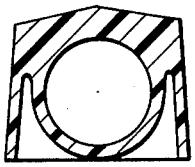
FIG. 6
FIG. 7
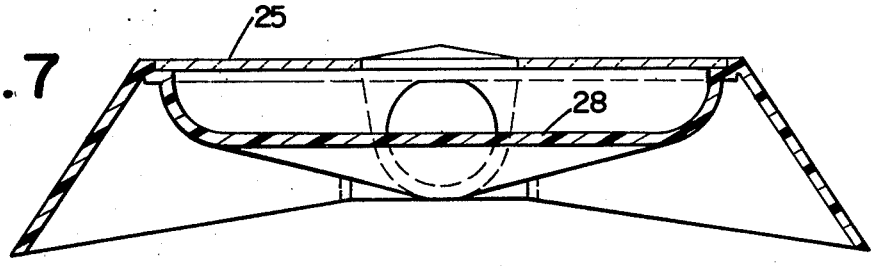
FIG. 8
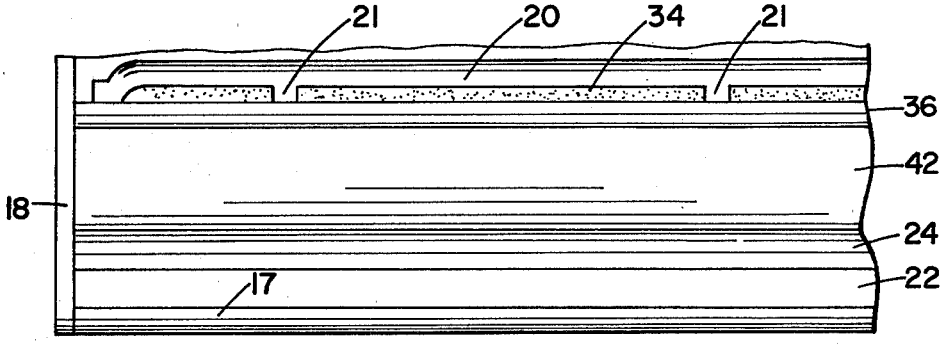

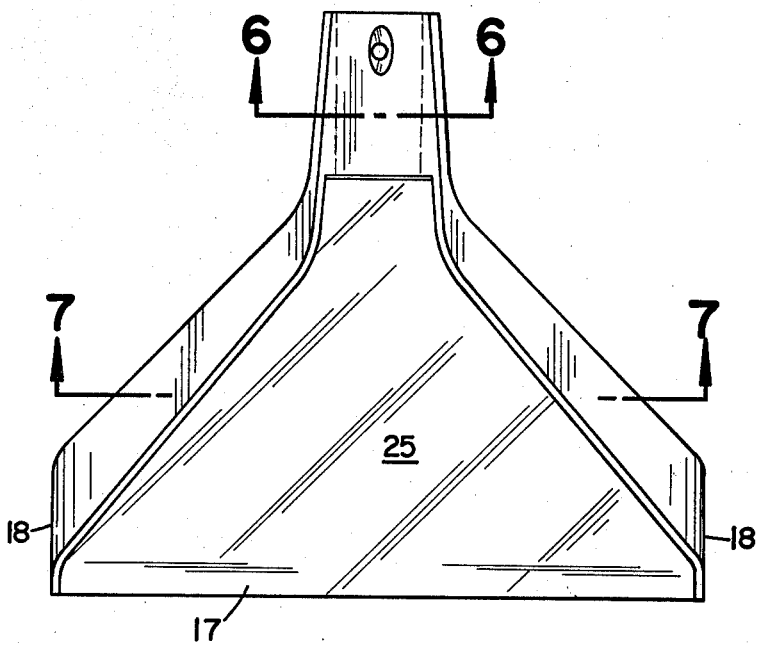
FIG. 2
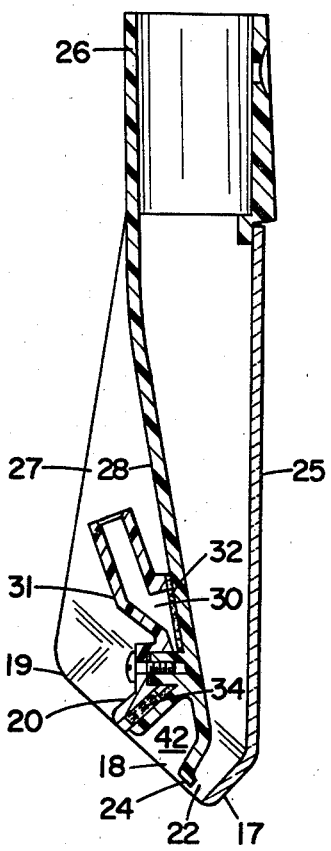
FIG. 4
FIG. 3
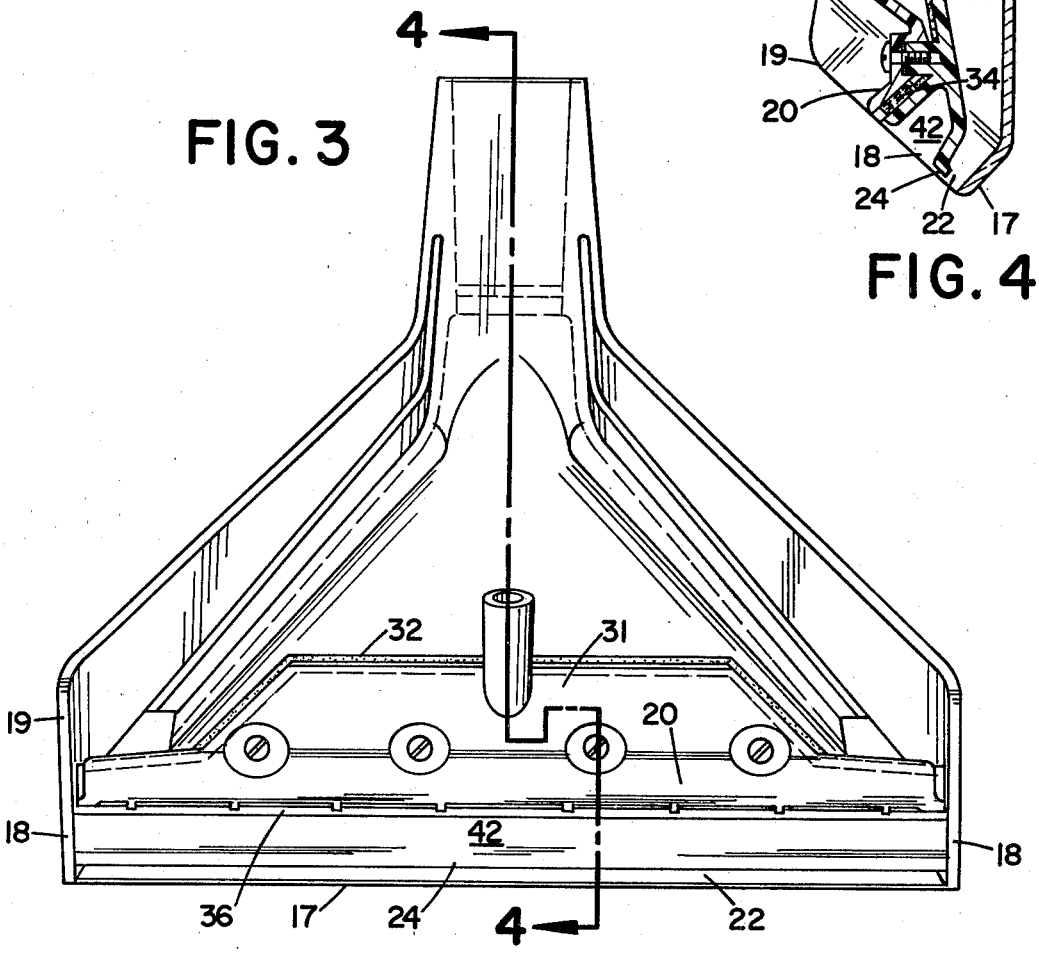

SURFACE CLEANING MACHINE

This invention relates to wet vacuum cleaners for carpets or rugs (hereinafter "carpet" will be understood to refer to either a carpet or a rug), of the type which continuously apply a cleaning fluid such as water or water to which cleaning agents have been added, subject the wetted fabric to cleaning action, and then vacuum off the soil-laden cleaning fluid.

A problem in the operation of prior art wet vacuum cleaners is that of soaking the carpet with the cleaning fluid to the point where the fluid penetrates in considerable quantity to the base of the carpet and to lower regions of the carpet fibers. This problem is particularly acute where the fluid is sprayed on the carpet with sufficient force or in sufficient quantity to make possible vigorous mechanical cleaning action by the fluid. Since initial soiling of the carpet occurs at the upper regions of the fibers, and these upper regions are where the important cleaning takes place both from the standpoint of soil removal and appearance, it is desirable to provide a plentiful supply of cleaning fluid at such upper regions so that vacuum action can provide or contribute to a vigorous and thorough cleaning action. But prior art cleaners which provide a plentiful supply of cleaning fluid at top regions of the carpet also tend to soak the lower portions. A significant proportion of the cleaning fluid which soaks into the lower portions of the carpet cannot be readily removed by vacuuming at practical power levels and within practical time constraints. To the extent that such penetrating cleaning fluid is not removed by vacuuming, it must be allowed to dry by evaporation. The evaporated fluid may leave behind in the lower portions of the carpet undesirable caked deposits of soil which the fluid has absorbed on the way into the carpet, or which the fluid first encounters at the lower portions of the carpet. Since such soil may be dust or other powdered or particulate material which could have been readily dry vacuumed, wet cleaning may be regressive to the extent that it may fix in the carpeting soil which would otherwise be removable by dry vacuuming.

Undesirable effects of deep fluid penetration as encountered in the prior art include prolongation of drying time, minimizing of percentage recovery of the fluid, and a tendency to embed soil which would otherwise be removable.

Some prior art wet cleaners have applied cleaning fluid to the carpet in the form of fine drops or mist, and the deposited fluid is then vacuumed off, thereby avoiding excess penetration while cleaning. However, cleaning fluid such as water that is applied in this manner is dispersed on the carpet as a relatively light deposit. Application of vacuum simply strips the deposit of fluid from the carpet fibers, along with any absorbed soil, and does not subject the carpet to vigorous mechanical cleaning action by the fluid so as to enhance soil removal.

There has long been a need for a cleaner which would both give a vigorous cleaning action and avoid the problems of excess fluid penetration. The present invention meets this need. The present invention achieves vigorous and thorough cleaning action at upper regions of the carpet where it is needed, very high cleaning fluid recovery rates, and very short drying times. Recovery rates may be in excess of 90% and drying time may be measured in minutes rather than hours. Embedment of soil in deeper portions of the carpet and the possibility of damage to rug backing are also minimized.

THE PRIOR ART

Koellisch U.S. Pat. No. 3,747,155 feeds cleaning fluid from spray nozzles 65 (FIGS. 5–7) in the form of fine drops or mist, which is deposited on the carpet in the manner seen in FIG. 7. "Whenever there is a flow of cleaning fluid from nozzles 65 onto a rug 81 being cleaned, the suction will draw the cleaning fluid and dirt upward through fibers 68 and nozzle 2 as cleaner 1 is being moved back and forth across the carpet, preventing excess moisture from being deposited onto the rug backing 82."

Collier U.S. Pat. No. 3,962,745 sprays cleaning fluid onto carpeting from nozzles 17, and the force of the spray of the cleaning fluid is relied on for cleaning action. The cleaning fluid is drawn off by vacuum.

Fitzgerald U.S. Pat. No. 3,840,935 directs a high pressure spray of cleaning fluid on a carpet from nozzles 41 (FIG. 6). A plate or partition 39 (FIG. 4) of critical shape and dimension between the spray compartment and water pickup compartment is said to contribute to vigorous cleaning action and efficient water pickup.

Cyphert U.S. Pat. No. 4,019,218 sprays cleaning fluid onto carpeting from nozzles 63 (FIG. 5). The nozzles of the orifices are "specifically configured to provide a high velocity fan-shaped spray which forcefully penetrates the pile of the carpet and simultaneously exerts sufficient force to dislodge attached nodules of dirt from the pile." A brush 51 (FIG. 4) carried on spring plates 71, 72 (FIG. 3) contributes to the mechanical cleaning action.

Monson U.S. Pat. No. 4,127,913 feeds water from a faucet through a nozzle 64 (FIGS. 6A, 6B). Separate cleaning solution in reservoir 86 is sprayed on by spray gun 84. In one mode of use, no separate cleaning fluid is used. Water is sprayed on and then the head is moved back and forth across the surface to draw up water and loosened soil.

Hufton U.S. Pat. No. 3,992,747 is intended to clean hard surface floors. Squeegees 116 (FIG. 9) surround a "scrubbing pad" 76 (FIGS. 4–6). Cleaning fluid is sprayed through three nozzles 102 (FIG. 4).

Morrill U.S. Pat. No. 2,885,713 is intended for use "in scrubbing floors and the like." Cleaning fluid passes from the sponge 34 (FIG. 2) "during a scrubbing operation." As this occurs, the cleaning fluid is "picked up by the suction fitting 68."

Krammes U.S. Pat. No. Re. 25,939 is a floor scrubber device with two modes of operation. In the scrubbing mode (FIG. 2) a sponge-rubber scrubber pad 56 of the scrubbing unit 22 is secured to a backing member 57 which closes the suction mouth 55, and cleaning fluid for a floor surface is dispensed from tube 20. In the squeegee mode (FIG. 1) the scrubbing unit 22 is removed and replaced by the squeegee unit 21, opening the suction mouth 55 (FIG. 2). Cleaning fluid gathered by the squeegee under the vacuum mouth is picked up by vacuum.

SUMMARY OF THE INVENTION

The present invention applies a continuously replenished bead of cleaning fluid to the top of the carpet and immediately vacuum-entrains the applied fluid with vacuum air at the point of application. The entrained fluid and vacuum air are transported along upper portions of the carpet to a vacuum pickup or uptake, with only limited downward penetration of fluid into lower portions of the carpet. The fluid is violently pulled from the bead or from the region of the bead by the force of the applied vacuum and a vigorous cleaning action is provided along the top portion of the carpet between the region of the bead and the point of vacuum uptake. Preferably, such transport of the fluid through the top part of the carpet occurs across a plenum or dead space defined in the cleaner head between the bead and the vacuum uptake.

A description of a concrete illustrated example of the invention follows.

In the accompanying drawings,

FIG. 1 illustrates the handle and head of a cleaner embodying the invention.

FIG. 2 is a view on a larger scale taken from the top right of the cleaner head of FIG. 1.

FIG. 3 is a view on a still somewhat larger scale of the cleaner head taken from the bottom left of FIG. 1.

FIG. 4 is a view taken from line 4—4 of FIG. 3.

FIG. 5 is a sectional view of the lower portion of the cleaner head in association with a carpet being cleaned, taken on an even larger scale than any of the preceding views.

FIG. 6 is a view taken on line 6—6 in FIG. 2.

FIG. 7 is a view taken on line 7—7 in FIG. 2.

FIG. 8 is a fragmentary view taken on line 8—8 of FIG. 5, but with the carpet omitted.

A vacuum source (not shown) supplies the cleaner handle 10 with suction through vacuum line 11. Cleaning fluid from a cleaning fluid reservoir (not shown) is provided to a fluid line 13. The fluid supply may be turned on and off by a squeeze grip valve 14. The vacuum and fluid lines 11, 13 lead from a canister (not shown) containing the vacuum source, the cleaning fluid reservoir, and a tank for returned dirty fluid removed by vacuuming.

The handle 10 is in effect a rigid extension of the vacuum line 11 and leads to the vacuum head 12. The fluid line 13 continues beyond the valve 14 and also leads to the head 12. The line 13 may be suitably supported along the handle 10, as shown.

The bottom face 15 of the head 12 is adapted to rest flat against a carpet 16 to be cleaned, in the attitude shown in FIGS. 1 and 5, and to be moved back and forth over the carpet surface. The face 15 is defined by the lower edges of the front wall 17 (FIGS. 2–5, 8) and the side walls 18 (FIGS. 3–5, 8). A back wall 20 (FIGS. 2–5, 8) is preferably also provided and also extends to the lower face 15, as shown, or at least extends to a small distance above the face 15. Rearward extensions 19 of the side walls 18 may be provided extending rearwardly beyond the back wall 20 to provide a substantially broader tool-to-floor base for proper head-to-floor orientation than would be provided without such extensions.

A vacuum uptake mouth or slot 22 is defined between the front wall 17 and transverse lip 24. Lip 24 is formed along with the side walls 18 as a unitary injection-molded part which also comprises most of the illustrated head structure including the handle socket 26 (FIG. 4) and the parts of the head 10 which define the outwardly flared vacuum connection between the handle 10 and the vacuum uptake mouth 22. The rear wall 28 (FIGS. 4, 5, 7) of this connection may be located inwardly of skirts 27 which taper upwardly from the rearward side wall extensions 19. In the illustrated cleaner all of these parts are unitary with the exception of a front plate 25, which is preferably separately formed of transparent plastic. Front wall 17 is a unitary part of front plate 25. Front plate 25 is inset into the front of the unitary molding in a manner most clearly seen in FIGS. 2, 4, and 7, and is fastened thereto by ultrasonic welding or adhesive means (not shown).

A fluid distributing manifold chamber 30 (FIGS. 4, 5) is defined by an injection-molded manifold 31 which is bolted against the rear wall 28 in the manner shown, suitable mating bosses being formed on the rear wall 28 and the manifold 31 for this purpose. Between these mating bosses and between the manifold 31 and the rear wall 28 proper, gasketing 32 (FIGS. 2–5) is provided to provide liquid-tight joints between the parts.

The upper part of manifold 31 is formed to receive fluid line 13. The lower edge of manifold 31 forms back wall 20. A felt strip 34 (FIGS. 4, 5) is held between the back wall 20 and a lip 36 extending from the wall 28. Retention of this strip 34 may be aided by small spaced retainers 21 (FIGS. 3, 4, 8) extending integrally forwardly from back wall 20. The projections 21 cannot be seen in FIG. 5, since they are obscured by an illustrated bead of fluid 40.

The bead of fluid 40 is formed by water or other cleaning fluid seeping through the felt 34 from the manifold chamber 30. In the operation of the cleaner, the valve 14 is opened to supply fluid to the chamber 30. Appropriate means, such as a small pump in the canister (not shown), is provided to supply a sufficient head of pressure to cause the fluid to seep through the felt and keep the fluid bead 40 replenished. The fluid bead 40 contacts carpeting being cleaned, and is supplied and replenished by the arrangement described. Preferably before the bead forms, or as it is forming, the user applies vacuum by turning on a suitable switch (not shown) controlling the vacuum source. As a result, vacuum from the vacuum uptake 22 is applied to pull cleaning fluid, supplied from the felt 34, through upper portions of the carpet across a cleaning zone extending from the bead 40 to the vacuum uptake 22.

It is to be noted that the bead 40 provides a metered work-distributed supply of water, so that each increment of the width of the swath or treatment path is supplied with fluid at the same rate as other increments and presents the fluid to the carpet under the same conditions as other increments (ignoring the negligible aberrations caused in the bead by the small projections 21).

The bead is constantly depleted by entrainment with vacuum air, by capillary attraction of the carpet, or by the wiping action caused by drawing the head across the carpet, but the bead is maintained and replenished from the felt 34.

The action of the vacuum in entraining the fluid from the bead 40 or from the carpet in the vicinity of the bead provides a vigorous cleaning action at the top portions of the carpet and limits downward penetration of the fluid into the pile, thereby enhancing fluid recovery and shortening drying time.

It is presently preferred to provide a structure as shown which defines a plenum 42 immediately above the cleaning zone. The present preference for the provision of a relatively deep plenum such as illustrated plenum 42 is a result of a considerable enhancement of vigorous cleaning action that seems to result from the action of entrained air and fluid within the plenum space. This action is not clearly understood, but is believed to include a swirling, churning "turbulation" of the fluids within the plenum. Since applicant has not to date been able to directly observe or photograph the form or shape of this fluid action, no attempt has been made in FIG. 5 to indicate such in-plenum action, as by including flow arrows or the like within the illustration of the cross-section of plenum 42.

However, the invention also contemplates an arrangement where the plenum 42 is eliminated and the lips 36 and 24 are formed as a single lip. Intermediate arrangements may also be employed, as for example, making the plenum 42 more shallow than shown even to the point where it substantially disappears to be replaced by a horizontal surface which rides on the carpet top between the lips 36 and 24.

In a preferred mode of use, the operator first turns on the vacuum power and then strokes the tool back and forth over the carpeting to be cleaned, turning the valve 14 on at the beginning of each rearward stroke and off at the conclusion of each rearward stroke. The felt 34 is preferably chosen so as to require the slight supply pressure in addition to any standing pressure head before it will pass sufficient fluid to replenish the bead 40. Accordingly, laying down or wiping on of fluid during forward strokes of the tool is desirably minimized or eliminated for most efficient use of fluid and further minimization of deep wetting of the carpet.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a carpet cleaner, a cleaner head having a bottom face, bead-forming means on the head for maintaining and replenishing a bead of cleaning fluid extending from side to side across said bottom face in contacting wipable relationship with the carpet to be cleaned, the bead-forming means including a fluid distributing manifold chamber and means interposed between the manifold chamber and the carpet to limit the velocity at which cleaning fluid is deposited on the carpet to a relatively low value and to ensure that the rate of deposit is substantially the same across said side to side extent, said bead tending to be depleted by entrainment with vacuum air, by capillary attraction of the carpet to be cleaned, or by the wiping action caused by drawing said head across the carpet, vacuum uptake means extending from side to side across said bottom face and generally parallel to said bead-forming means for drawing vacuum air past said bead to entrain fluid from said bead or from said carpet in the vicinity of said bead and for recapturing said entrained fluid together with dirt removed from the carpet.

2. A cleaner as in claim 1 in which the bead-forming means and the vacuum uptake means are separated at the bottom face by an intermediate zone extending from side to side across said bottom face.

3. In a carpet cleaner, a cleaner having a bottom face, bead-forming means for maintaining and replenishing a bead of cleaning fluid extending from side to side across said bottom face, said bead tending to be depleted by entrainment with vacuum air, by capillary attraction of the carpet to be cleaned, or by the wiping action caused by drawing said head across the carpet, vacuum uptake means extending from side to said across said bottom face and generally parallel to said bead-forming means for drawing vacuum air past said bead to entrain fluid from said bead or from said carpet in the vicinity of said bead and for recapturing said entrained fluid together with dirt removed from the carpet, the bead-forming means and the vacuum uptake means being separated at the bottom face by an intermediate zone extending from side to side across said bottom face, and a plenum formed in the head which is open to the bottom face at said intermediate zone.

4. A cleaner as in claim 1 in which said bead-forming means and vacuum uptake means are collectively surrounded by front and side walls depending from said head.

5. A cleaner as in claim 4 in which said bead-forming means and vacuum pickup means are collectively surrounded by front, side, and back walls depending from said head.

6. A cleaner as in claim 4 in which the bottoms of said side walls extend rearwardly beyond said back wall to provide a substantially broader tool-to-floor base for proper head-to-floor orientation than would be provided without said extensions.

7. A carpet cleaner comprising a head having a generally open bottom face, handle means for the head, a vacuum source, a cleaning fluid reservoir, said head including means for defining a cleaning zone extending across the width of the head at said bottom face, said head including cleaning fluid wipe-on means at said bottom face and extending across the width of the head on one side of said cleaning zone, said head including means for distributing and feeding cleaning fluid drawn from said cleaning fluid reservoir along the extent of said cleaning fluid wipe-on means, said head including a vacuum uptake communicating with said vacuum source, said vacuum uptake being at said bottom face and extending across the width of the web on the other side of said cleaning zone from said cleaning fluid wipe-on means, said cleaning fluid wipe-on means, cleaning zone, and vacuum uptake collectively being surrounded by front and side walls extending to the level of said bottom face, said walls cooperating to constrain air flowing to said vacuum uptake to entrain fluid supplied from said cleaning fluid wipe-on means and draw it across said cleaning zone.

8. A cleaner as in claim 7 in which a plenum in the head is open to the bottom face at said cleaning zone.

9. A cleaner as in claim 7 in which said cleaning fluid wipe-on means, cleaning zone, and vacuum uptake are collectively surrounded by front, side, and rear walls.

10. In a carpet cleaner having a cleaner head, vacuum uptake means in the cleaner head, cleaning fluid presenting means in the cleaner head for presenting a long narrow bead of cleaning fluid in contacting wipable relationship with the top of a carpet being cleaned, said bead extending across the width of the head, the presenting means including a fluid distributing manifold chamber and means interposed between the manifold chamber and the carpet to limit the velocity at which cleaning fluid is deposited on the carpet to a relatively low value and to ensure that the rate of deposit is substantially the same across said side to side extent, and vacuum confining means for applying the vacuum from the vacuum uptake means across a cleaning zone, laterally coextensive with the bead and extending logitudinally from the presented bead to the vacuum uptake means, to pull the fluid from the bead through upper portions of said carpet across said zone to said vacuum uptake means.

11. In a carpet cleaner having a cleaner head, vacuum means in the cleaner head, cleaning fluid presenting means in the cleaner head for presenting a long narrow bead of cleaning fluid in wetting relationship with the top of a carpet being cleaned, said bead extending across the width of the head, and vacuum confining means for applying the vacuum from the vacuum uptake means across a cleaning zone, laterally coextensive with the bead and extending longitudinally from the presented bead to the vacuum uptake means, to pull the fluid from the bead through upper portions of said carpet across said zone to said vacuum uptake means, said head defining a vacuum plenum above said zone.

* * * * *